United States Patent [19]

Schippers et al.

[11] 4,221,345

[45] Sep. 9, 1980

[54] ROTARY FILAMENT FEEDER

[75] Inventors: Heinz Schippers; Karl Bauer; Erich Lenk; Peter Dammann, all of Remscheid, Fed. Rep. of Germany

[73] Assignee: Barmag Barmer Maschinenfabrik AG, Remscheid-Lennep, Fed. Rep. of Germany

[21] Appl. No.: 901,595

[22] Filed: May 1, 1978

Related U.S. Application Data

[63] Continuation of Ser. No. 664,660, Mar. 8, 1976, abandoned.

[30] Foreign Application Priority Data

Mar. 7, 1975 [DE] Fed. Rep. of Germany ..... 7507160
Sep. 9, 1975 [DE] Fed. Rep. of Germany ..... 2540148

[51] Int. Cl.[3] ..... B65H 54/80

[52] U.S. Cl. ..... 242/47; 28/289; 242/82; 242/83

[58] Field of Search ..... 242/47, 82, 83; 28/289; 19/159 R

[56] References Cited

U.S. PATENT DOCUMENTS

| | | | |
|---|---|---|---|
| 444,652 | 1/1891 | Roberts | 242/82 |
| 627,722 | 6/1899 | Edwards | 242/82 X |
| 2,997,249 | 8/1961 | Meinshausen | 242/82 |
| 3,128,961 | 4/1964 | Wickwire | 242/82 |
| 3,141,201 | 7/1964 | Gasser | 19/159 R |
| 3,204,940 | 9/1965 | Morgan | 242/82 X |
| 3,563,488 | 2/1971 | Bollig | 242/82 |
| 3,656,701 | 4/1971 | Dibrell | 242/82 X |
| 3,703,261 | 11/1972 | Cofer et al. | 242/82 |
| 3,780,963 | 12/1973 | Hirschfelder | 242/82 |
| 3,843,072 | 10/1974 | Rayfield | 242/82 |

FOREIGN PATENT DOCUMENTS

| | | | |
|---|---|---|---|
| 1029783 | 5/1958 | Fed. Rep. of Germany | 242/82 |
| 18138 | of 1890 | United Kingdom | 242/82 |

*Primary Examiner*—Stanley N. Gilbreath
*Attorney, Agent, or Firm*—John H. Shurtleff

[57] ABSTRACT

Devices and processes for feeding freshly spun and/or stretched filaments, which are delivered to the devices at more than 1000 meters/min., in helices to a receptacle, said devices embodying a rotating member with curvate passage extending from its upper inlet, which lies in the axis of rotation, to its outlet opening at a radial and axial spacing from the inlet, the axis of the outlet opening facing opposite to the direction of orbit thereof and the tangent of the passage's radially outer wall surface contiguous to said outlet opening forming an angle between 30° and 80° with reference to the radius, drawn through the outlet opening, of the circle of rotation of the outlet opening.

14 Claims, 10 Drawing Figures

ROTARY FILAMENT FEEDER

This is a continuation, of application Ser. No. 664,660 filed Mar. 8, 1976, now abandoned.

BACKGROUND OF THE INVENTION

For purposes of the disclosure and claims, the term "filaments" applies to monofilaments and to plied or unplied combinations of two or more monofilaments or fibrous strands twisted into threads, yarns and/or cables or as untwisted bundles, tows, etc. The filaments and/or fibers are made of synthetic, spinnable, thermoplastic polymers.

Devices for laying such filaments, upon their delivery from spinning installations in the case of freshly spun, stretched or unstretched filaments, include rotating delivery tubes or piddlers which deliver the filaments as helices to canisters or other collectors. U.S. Pat. Nos. 2,971,683 and 3,706,407 describe devices of this type. The rotating guide tube of these devices has a simple curvature and in its emergence zone—as seen in projection onto its plane of rotation—is radially directed. The disadvantage of this tube construction lies in that the velocity of the filament(s) at the exit of the guide tube, with respect to a spatially fixed coordinate system extending through the axis of rotation of the tube, is further increased with respect to the velocity of filament feed to the guide tube, whereby the filament(s) gain kinetic energy, instead of reducing this energy. This is clear if one realizes that, to the radially directed velocity of the filament(s) passing out the exit end of the tube, there must be added vectorially the peripheral velocity of the rotating guide tube at the emergence end. Therefore, the resulting velocity of the exiting filament(s) is always greater than the feed volocity. The consequence of the velocity increase is that the filament(s), after leaving the rotating guide tube, is/are borne so far radially outwardly that the air resistance between the exiting filament(s) and the substantially stationary ambient air and the tension force caused by the rotary movement of the downstream filament helices suffice to deflect the filament(s) at the emergence from the guide tube oppositely to the orbiting direction of the guide tube's discharge opening. This can lead, especially in the case of high linear velocity of the filament(s), to the result that the lay-down of the filament(s) in the receptacle is not satisfactory. On the one hand, helices of the filament(s) can easily expand beyond the edge of the receptacle. On the other hand, the rotary movement of the free helices in the zone between guide tube and receptacle tend to entangle with the already deposited spiral windings of the filaments. The entanglements severely impair the later removal of the filament(s). The rotary movement of the helices about the axis of rotation is necessary in order to generate by centrifugal forces the necessary pulling force for the deflection of the filament(s) at the exit of the radially direction tube.

To explain the rotary movement occurring in a device of the category mentioned: Upon the vertical falling movement of an observed filament there is superimposed a rotary movement. The resulting curve path of the filament(s) is a helical line. This is to be distinguished from the filament helix visible to the observer in a stop-action photograph, which is interpreted as a flow path which starts at the exit of the guide tube and rotates with the tube about the axis of rotation of the device, and through which each filament travels.

German Pat. No. 1,115,622 and German Published application AS No. 1,510,310 describe known rotary heads having guide tubes for the filament(s) to be deposited exiting tangentially to their rotary arcs. These structures have an inherently high tendency to clog because, in the zone of the emergence opening of a tangentially directed guide tube, the resultant acceleration imparted to the exiting filaments is directed perpendicularly to the filament passage. The resultant high friction forces in the conveyance direction lead to the clogging tendencies. Such a rotary head, therefore, can function effectively only because the head lays the exiting filament(s) onto the layers already deposited in the collecting canister (cf. for example, German Pat. No. 1,019,222), whereby a pull is exerted on the filament(s) emerging from the guide passage of the rotating head. These known devices are used for the depositing of spun or drawn bundles in the fiber yarn spinning preparation machines at substantially lower operating speeds.

THE INVENTION

An object of the invention is the elimination of the disadvantages affecting the known devices and the improvement of the depositing process for filament(s), especially at high filament-delivery speeds, in such a manner that virtually the entire kinetic energy of the filament(s) derived from its/their high translatory delivery velocity is withdrawn therefrom, and the filament(s) is/are conveyed in a helical configuration between the rotating depositing member and the collection canister. The filament(s) is/are steadily conveyed in the guide channel of the depositing member by the acting forces of inertia, and transverse forces, which promote, in interaction with the friction of the filament(s) upon the wall of the guide channel, the clogging of the guide channel, are avoided or minimized.

Briefly, the invention provides devices for feeding freshly spun and/or stretched filament(s) delivered at delivery speeds of more than 1000 meters per minute to a depositing collector, e.g., a canister, in helical or spiral windings. The devices embody a rotatably driven member with a curved guide passage, said member having a vertical axis of rotation. The inlet opening of the guide passage is near to or coaxial with the axis of rotation. The outlet opening is positioned at a radial and downwardly axial spacing from the inlet opening. The tangent of the guide passage in the zone of the outlet opening is at an angle to a plane which is normal (90°) relative to the axis of rotation. A curved, filament-guide channel extends between the inlet and outlet openings. The guide passage is spatially curved in a manner known per se between the inlet opening and the outlet opening with the tangent to the guide passage providing, in the region of the outlet opening, an angle $\beta$ in the range of 30° to 80° with respect to the radius of the latter opening's circle of rotation.

A main advantage of the invention consists, with respect to known devices, in that the filament(s), upon emergence from the rotating guide channel, is/are subjected to sufficiently high inertia forces in the direction of the guide passage to prevent a clogging of the guide passage. Further, the guide passage configuration leads to a stable winding-line (helical) configuration of the filament(s). With such guide passage, it is possible to consume the kinetic energy of the filament(s) delivered at high velocities over 1,000 meters per minute—even over 3,500 meters per minute—almost completely and to deposit the filament(s) without stowage, damage or snarling in the collecting canister. It is possible, further, to deposit the filament(s) delivered from spin-stretching or stretch-spinning processes in faultless layering in a rotating and/or translatorily traversing canister and to withdraw it/them later without difficulties even at high speeds.

The devices of the invention further assure that the conveyance forces acting on the filament(s) are suited, in direction and magnitude, to overcome the friction of the filament(s) on the wall of the guide passage.

The latter is accomplished, according to the invention, by providing that the radius of curvature $\rho$ of the guide passage in the emergence zone relative to the angle of emergence satisfies the mathematical relations:

$$\rho > \frac{r}{2 - \sin\beta + \frac{\cos\beta}{\mu}} \quad \text{or}$$

$$\rho < \frac{r}{2 - \sin\beta}$$

in which r is the radius of the circle of rotation of the emergence or outlet opening, $\beta$ is the angle between the tangent to the guide passage in the region of the outlet opening and the radius of the circle of rotation of the outlet opening, and $\mu$ is the coefficient of friction between the filament(s) and the guide tube or passage.

The first mathematical relation is particularly applicable.

The outlet opening has a downward angle $\alpha$, relative to the plane of its circle of rotation, of 5° to 30°. This assures that the winding configuration of the filament(s) after exit from the guide passage has a sufficient pitch (distance between helices) and falling speed. The emergence velocity of the filament(s) has a component acting in the direction of gravity.

The devices of the invention advantageously are suited to compensate the air resistance against the helically or spiral configured filament(s) in the vertical direction of movement. To attain same, the devices have, above and concentrically to the rotation circle of the emergence opening, an annular air nozzle with annular nozzle lips directed substantially vertically downwardly, optionally in combination with auxiliary structures which impart a circumferential air flow component to the air stream in addition to the substantially vertical flow vector.

A preferred embodiment of the invention, which is especially well suited for high filament-feed velocities and thereby for high rotary rates of the depositing member, has the guide passage embedded in a rotary body rotatably journalled and driven about a vertical axis of rotation substantially concentric with the vertical, entrant part of the passage. The emergence opening lies in the circumference (surface) of the rotary body. Concentrically to the rotary body is an annular air nozzle with nozzle lips directed essentially vertically downward in such a way that the nozzle lies free of contact with the rotary body, and above the outlet opening of the guide passage. Such rotary bodies facilitate provision of an aerodynamically favorable form of the rotor, which rotor can be easily manufactured and balanced.

The rotary bodies preferably have an upper, truncated-conical section concentric with the axis of rotation, an optional cylindrical concentric mid-section and a lower, concentric, preferably conical or frusto-conical, downwardly-extending section. The precise shape of the lower section is adapted to the air flow pattern forming in the operation of the device. It functions as an air displacer for the air curtain.

The truncated-conical, upper section of the rotary body may be provided with air flow channels commencing in the conical surface and issuing in the interior of the rotary body into an air channel extending coaxially to the axis of rotation and downwardly from the interior of the body to its lower side exit opening, the channel preferably flaring or widening in the downward direction.

Such rotors provide a special advantage in that the downward-falling, helical configuration of the filament(s) is not subjected to uncontrolled air flows which are parallel to the axis of rotation and are within the helical winding configuration of the falling filament(s). The rotary body and the annular air nozzle bring about placement of the helical winding configuration of the filament(s) in a downwardly-directed air flow.

The aforedescribed rotor having downwardly and radially-inwardly-directed air channels or passages which issue in a downwardly-directed air channel coaxial with the axis of rotation, which in turn emerges on the underside of the rotor, prevents formation of a subpressure zone underneath the rotor. Such subpressure zone would induce radially inward constriction of the annular stream of the downwardly-directed air supplied from the annular air nozzle, whereby the desired helical filament(s) pattern would be disturbed.

Further forms and developments of the devices of the invention are aimed at increasing the operating reliability of the devices over the broadest possible ranges, so that it is not absolutely necessary in the operation of the devices to carry out precision tuning of the rate of rotation relative to each type, denier, etc. of filament(s) and/or their respective linear feed velocities. Such further forms and developments include a hollow body, cylindrical or flaring downwardly in the form of a truncated cone, positioned concentrically with the rotation circle of the filament-emergence opening of the filament passage; such hollow body in the form of a noise insulating pot, open at the bottom, surrounding the rotary body, and extending therebeyond; such hollow body in the form of a cage consisting of spaced, vertical bars, the cage having a circular horizontal cross section; such cage in which the bars are mounted on a fixed support and are adjustable to differing angular positions and/or cage diameters; and annular air nozzles directed obliquely inwardly and downwardly and distributed at axial intervals along the longitudinal dimension of the cage or hollow body.

The process comprises feeding of filament(s) freshly spun or stretched, and delivered at delivery velocities of more than 1000 meters per minute vertically downwardly toward a collector (canister) in helical or spiral turns. The filament(s) is/are deflected from its/their linear direction of travel and, through superimposition of a rotary movement, is/are brought into a helical or spiral path. The deflection of the filament(s) into the helical path of movement takes place on a spatial curve, in such a way that during the deflection the kinetic energy of the translatory movement of the filament(s) is substantially consumed and is transferred to the deflection arrangement. Further, at each and all places along the spatial curve, the force of inertia acting in the direction of the spatial curve at each and all places along said curve exceeds the inhibiting frictional force of the surrounding atmosphere. In such processes, the moisture content of the filament(s), by earlier finishing or the like, is adjusted to a value of less than 12% (% by weight), preferably less than 5% (% by weight), of the filament(s)' mass.

What is essential to the process invention herein—and the distinction with respect to the state of technology becomes especially clear—is that according to the invention a depositing process for the polymer filaments is realized, underlying which is the principle of a reaction turbine and in which the great kinetic energy of the longitudinal, translatory movement of the filament(s), which energy is approximately completely consumed, is converted into kinetic energy of a rotary movement. Such conversion contributes to driving energy imparted to the rotary guide tubes or the rotor bodies. The limitation of the moisture of the filaments, supra, is essential inasmuch as, by this, the coefficient of friction $\mu$ between the filament(s) and the filament passage of guide pipe or the rotary body is affected. With relatively dry filaments having a moisture content of less than 3% by weight, virtually no dependence of the coefficient of friction $\mu$ on the cable velocity was found, while with moisture contents above 12% by weight this dependence must not be neglected for intermittently varying or purposely altered velocities and/or varying moisture contents.

The invention will be appreciated further from the description of preferred embodiments which are illustrated in the drawings, wherein.

Figure 1:
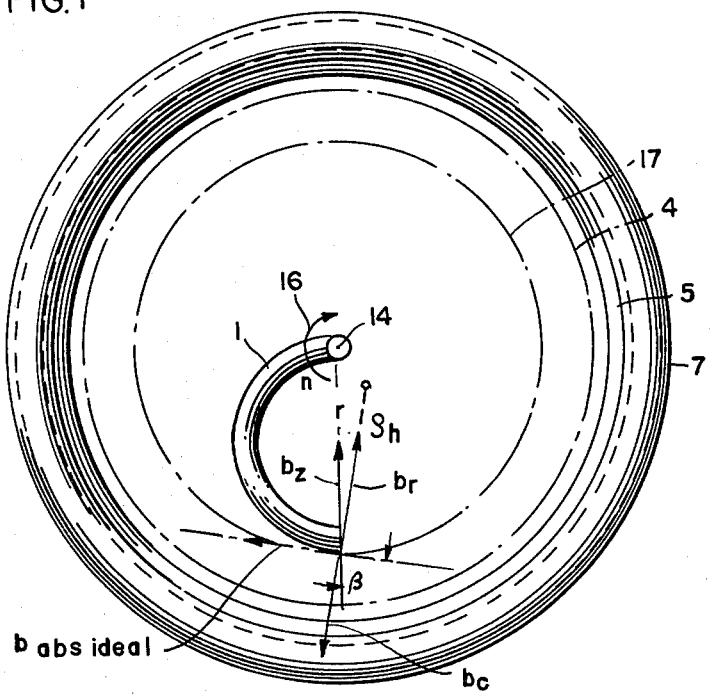
FIG. 1 is a top plan view of a filament feeding device with a rotating, curved filament guide tube with the feed rollers, gears and bearings omitted.
Figure 2:
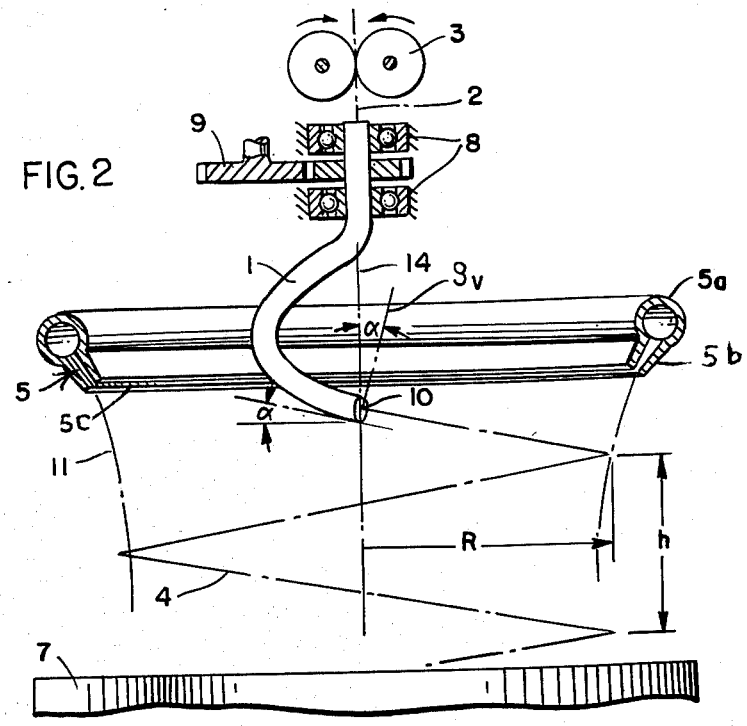
FIG. 2 is a side elevation, partly in diametric section, of the feeding device of FIG. 1.
Figure 3:
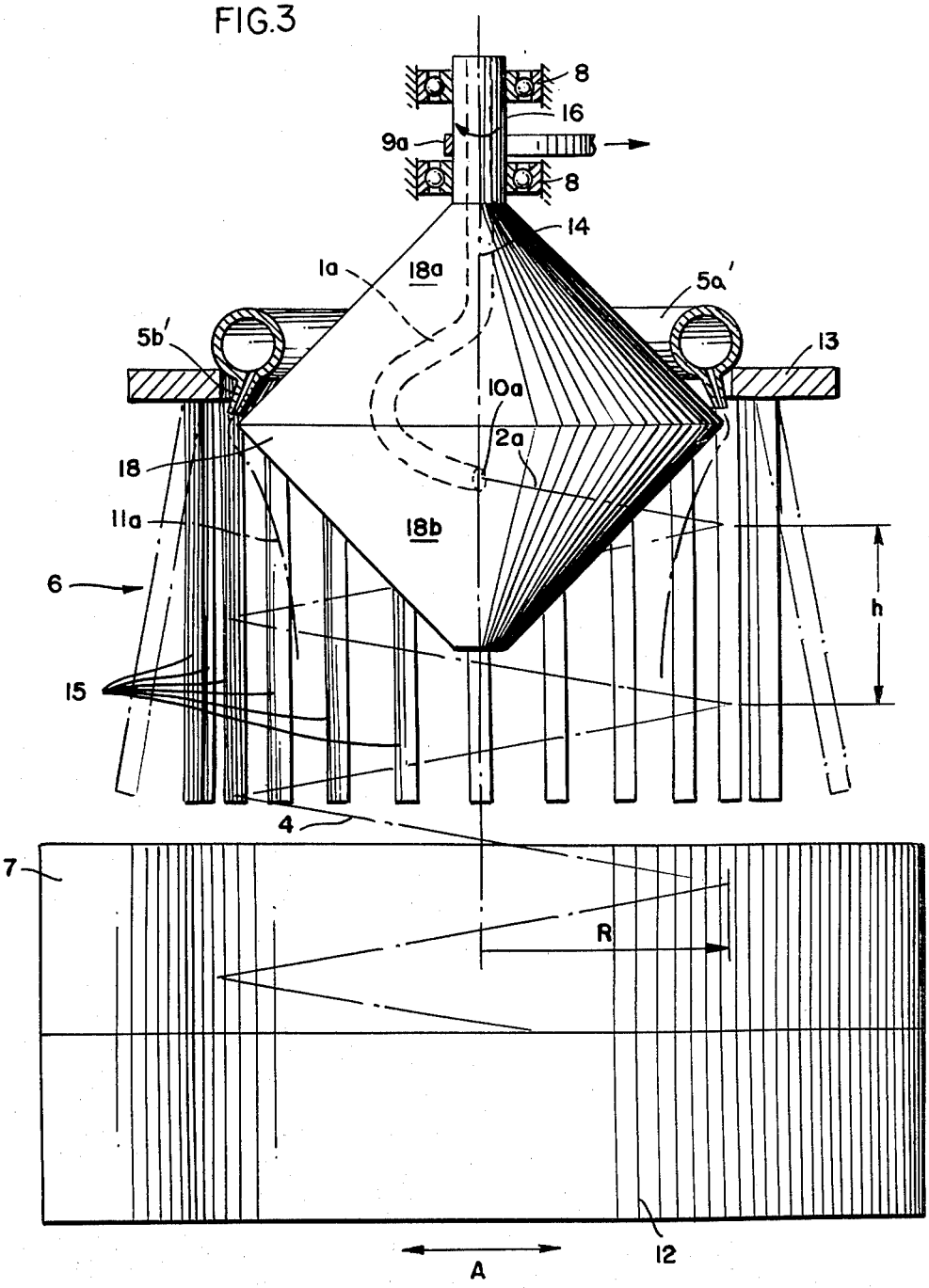
FIG. 3 is a side elevation, partly in diametric section, of a second embodiment utilizing a rotary body, with the curvate, filament-guide passage therein.
Figure 4:
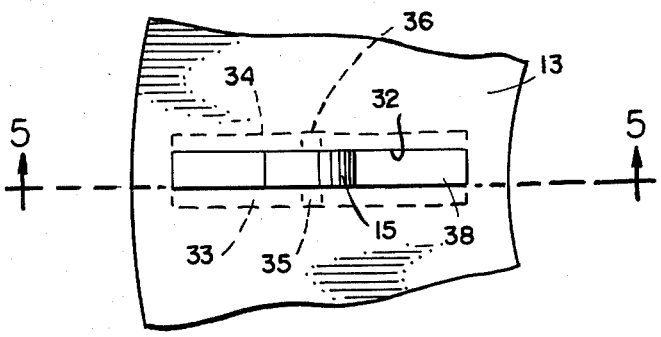
Figure 5:
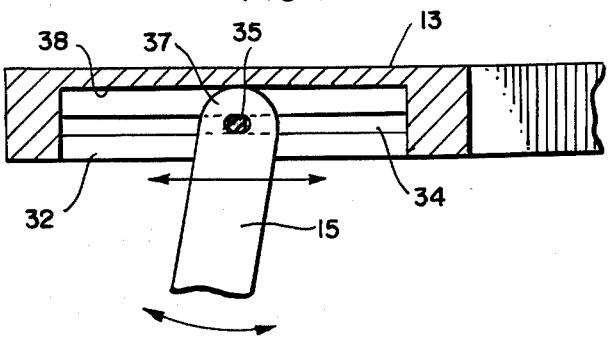
Figure 9:
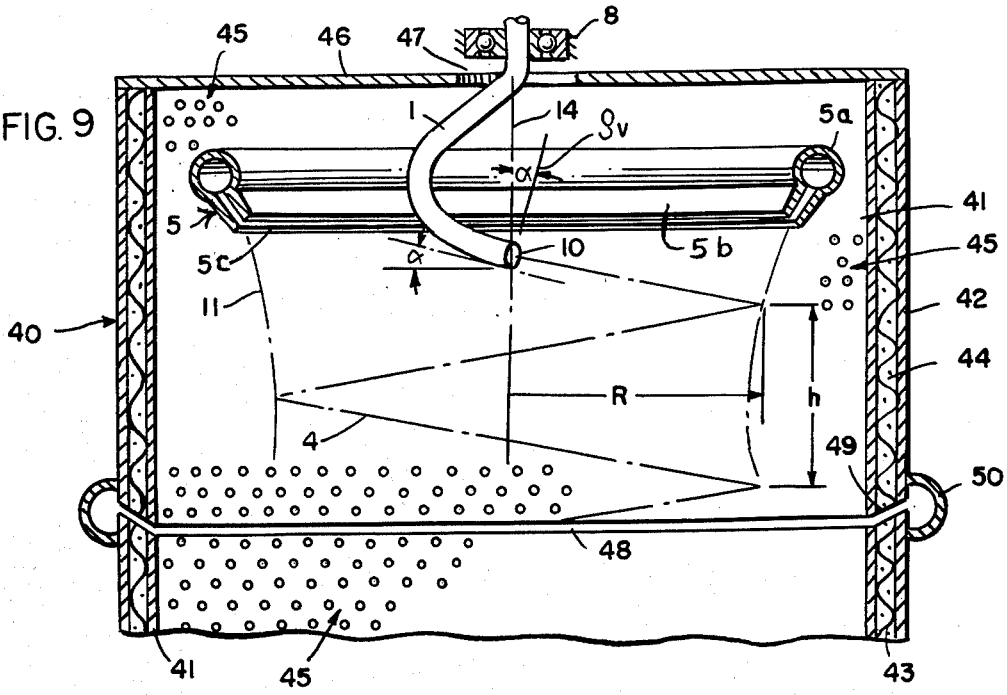
Figure 6:
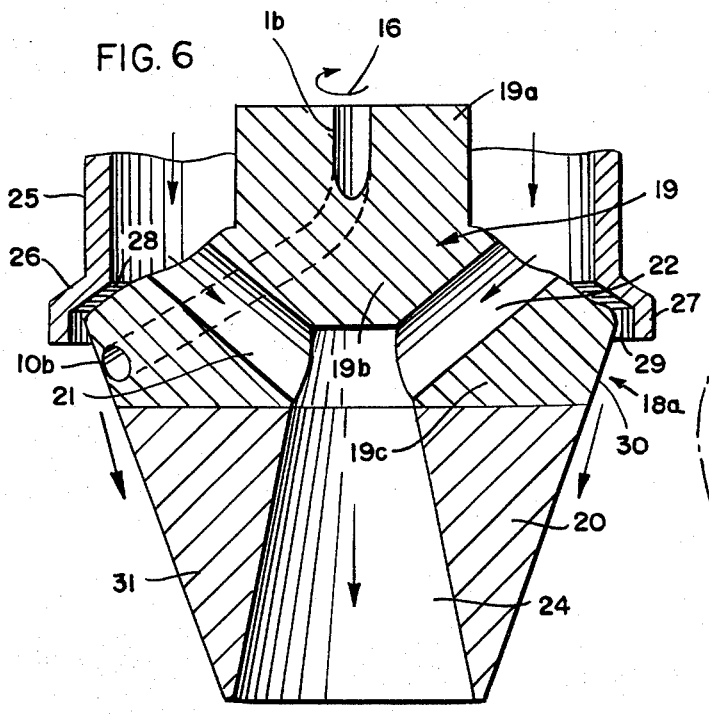
Figure 8:
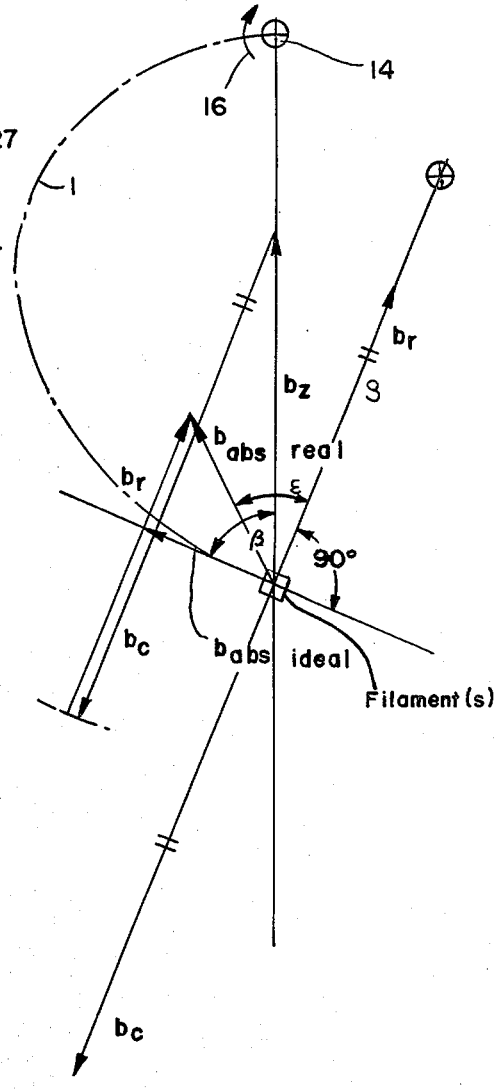
Figure 7:
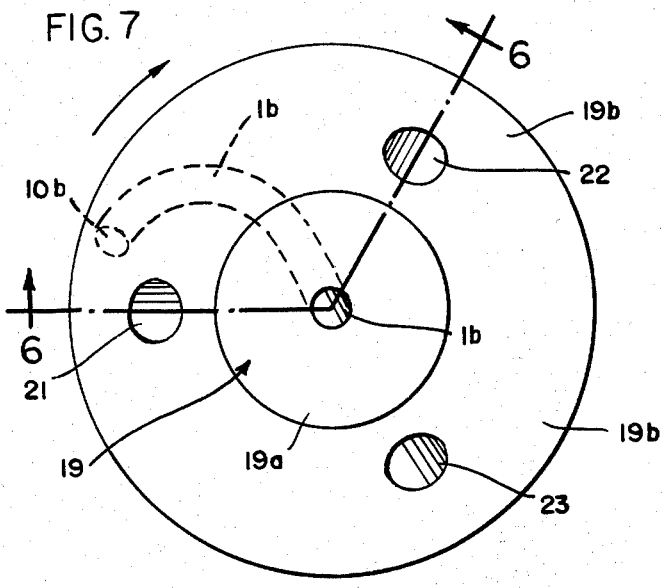
Figure 10:
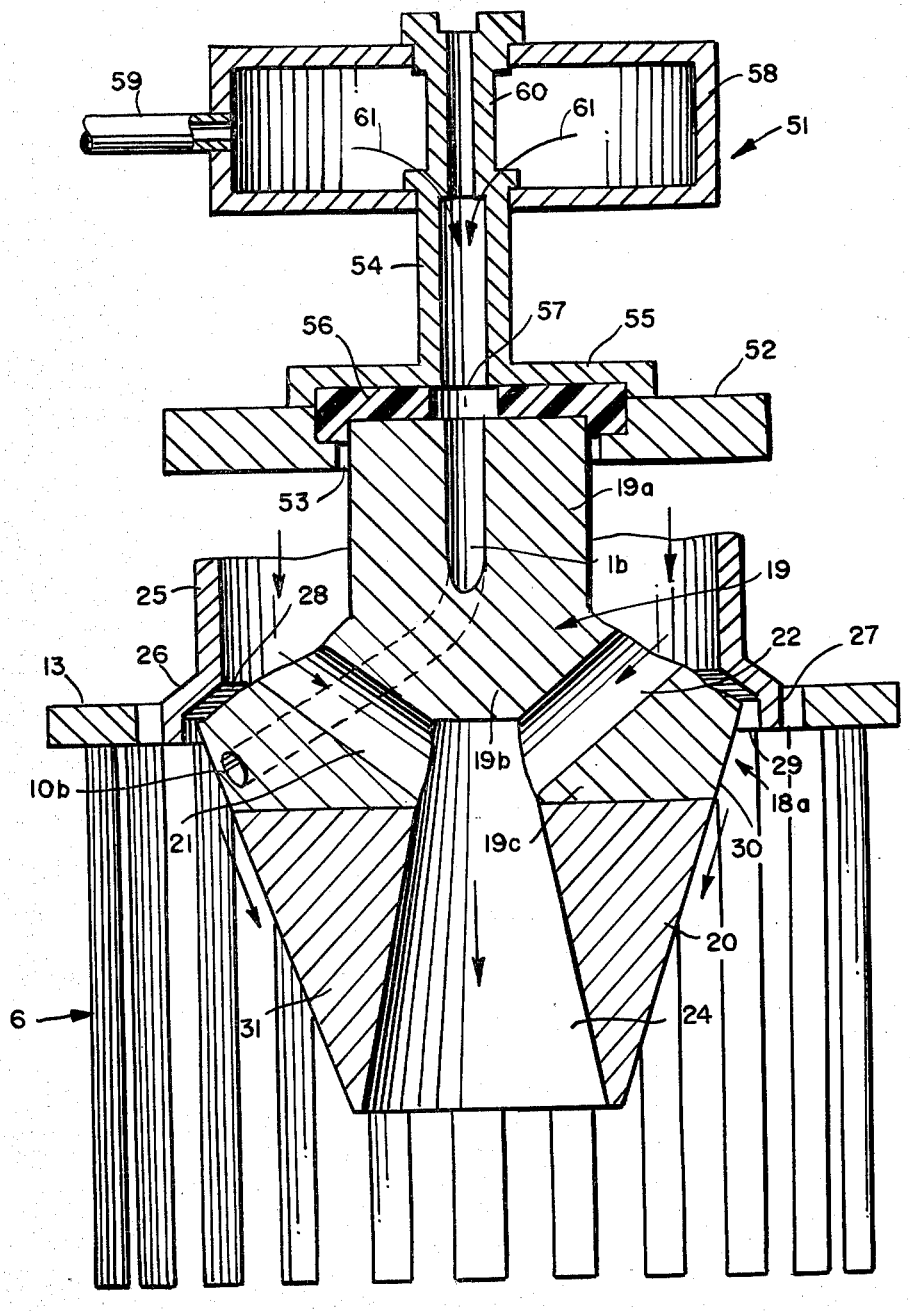

FIGS. 4 and 5, respectively, are fragmentary, enlarged detail views of the radially shiftable and pivotable bars in FIG. 3 in bottom plan view and a section view taken on line 5—5 of FIG. 4;

FIGS. 6 and 7, respectively, are a radii section view taken on line 6—6 of FIG. 7 and a top plan view (the latter with the air supply duct omitted) of another type of rotary body;

FIG. 8 is a motion and acceleration vector diagram of the forces at the orbiting emergence opening of the curvate filament passage of said rotating tube or said rotary bodies;

FIG. 9 is a fragmentary, diametric section of the feeding device of FIGS. 1 and 2 within a noise dampening casing; and FIG. 10 is an embodiment with the rotary body as shown in FIGS. 6 and 7 in combination with the spaced bar cage of the embodiment of FIG. 3 and an injector nozzle.

Referring to FIGS. 1 and 2, the entrant opening and entrant portion of the guide tube 1, into which the filament(s) are delivered by the filament-feed rollers 3, lie on the axis of rotation 14 of the guide tube. The guide tube 1 is rotatably journalled in bearings, for example the pair of roller bearings 8, and is driven by the drive gears 9 in the direction of rotation of the arrow 16. The rate of revolution (n) of the guide tube 1 is chosen in such a way that its circumferential velocity at the exit opening 10 relative to the diameter of the filament helices 4 is slightly greater, i.e., 5% to max. 20%, than the delivery velocity ($V_f$) of the filament(s) 2 just preceding their entrance into the guide tube.

The guide tube 1 has a composite curve. The radius of curvature is not constant over the length of the thread guide tube. At the emergence opening 10 the guide tube 1 has a radius of curvature ($\rho$). The latter's component in the horizontal plane of FIG. 1 has the value ($\rho_h$). Its component in the vertical plane of FIG. 2 has the value ($\rho_v$) and is attuned to the emergence angle ($\beta$) of the guide tube. Angle $\beta$ is the angle between the tangent to the guide tube 1 at the emergence opening 10 and the radius line through emergence opening 10 from the axis of rotation 14. The radius of curvature $\rho$, though varying over the length of the compositely curved guide tube, is chosen so that at every place in the guide rotating tube there is a resultant force of inertia whose component in filament-conveyance direction is greater than the frictional force between filament(s) and tube wall, whereby clogging of the filament-channel is prevented.

The shape of the composite curvature is largely noncritical so long as the radius of curvature $\rho$ of the guide tube 1 in the area of the emergence opening 10 satisfies the mathematical condition:

$$\frac{r}{2 - \sin\beta + \frac{\cos\beta}{\mu}} < \rho < \frac{r}{2 - \sin\beta}$$

In this formula, r is the radius of the rotary arc 17 of the emergence opening 10, and $\mu$ is the coefficient of friction of the sliding filament(s) with respect to the wall of the filament-passage (the inside wall) of the guide tube 1.

The angle $\beta$ is, according to this invention, less than 90° and lies preferably between 30° and 80°. Hereby, and by the attuning of the radius of curvature $\rho$ of the guide tube 1 in the area of the outlet opening 10, the filament(s) is/are conveyed by the positively acting inertia forces and on leaving the guide tube 1 still has/-have a velocity component relative to the velocity along the rotary arc (circle) 17 of the guide tube 1.

The pull forces acting on the filament(s) according to direction and value suffice with the indicated dimensioning of $\beta$ and $\rho$ to overcome the friction brought about by transverse forces of the filament(s) pressing against the filament passage, i.e., the inner wall of the guide tube 1. The most favorable angle $\beta$ must be optimized within the given limits by tests and selection which provide that the radius of curvature has a technically realizable magnitude in respect to the other operating conditions.

In the following, the mathematical relations are derived between the angle $\beta$ and the radius of curvature $\rho$ in the emergence opening 10 with consideration of the filament friction, in which connection reference is made to the vector diagram of the accelerations occurring according to FIG. 8.

1. The condition for ideal filament conveyance relations in the emergence zone is one wherein, for the particular filament(s) in question, the resulting acceleration $b_{abs}$ ideal has the same direction as the tangent to the guide tube 1 at the emergence opening 10, whereby there is no acceleration component and thereby no force component normal to the guide tube tangent. Under such ideal conditions, no frictional force acts on the filament(s) at the opening. For such ideal case there holds, with small angles $\alpha$, in good approximation:

$$\frac{|b_c| - |b_r|}{|b_z|} = \sin\beta ;$$

in which $b_c = 2 \cdot \omega \cdot v_f$ (Coriolis acceleration, lying in the drawing plane), $b_r = \frac{v_f^2}{\rho} = \omega^2 \cdot \rho$ (Relative acceleration, lying spatially)

$b_z = \omega^2 \cdot r$ (Centripetal acceleration, lying in the drawing plane).

With the special operating condition $\omega r = v_f$:

$$b_c = \frac{2 \cdot v_f^2}{r} ; \quad b_z = \frac{v_f^2}{r}$$

in which $\omega$=angular velocity r=radius on which the guide pipe 1 ends, $v_f$=delivery velocity of the filaments;

Accordingly:

$$\sin\beta = \frac{\frac{2v_f^2}{r} - \frac{v_f^2}{\rho}}{\frac{v_f^2}{r}} = 2 - \frac{r}{\rho} \text{ and}$$

$$\rho = \frac{r}{2 - \sin\beta} .$$

2. The condition for a positive conveyance of the filament(s) in the emergence zone of the guide tube by overcoming of the wall friction ($b_{abs.\ real}$, FIG. 8) is that:

angle $\epsilon$>arc. tan $\mu$;

tan $\epsilon > \mu$;

in which $\mu$=Coefficient of friction between the filament(s) and tubular passage;

$\epsilon$=Angle of friction at which self-arrest of the filament(s) occurs in the thread guide tube, i.e., when the friction drag overcomes the pull force on the filament(s).

From FIG. 4 it follows that:

$$|b_c| - |b_r| = |b_z| \cdot \sin\beta - \frac{|b_z| \cdot \cos\beta}{\tan\epsilon} ;$$

$$2\omega \cdot v_f - \frac{v_f^2}{\rho} = \omega^2 \cdot r(\sin\beta - \frac{\cos\beta}{\tan\epsilon});$$

With the special operating condition wherein $$\omega \cdot r = v_f; \ \omega = \frac{v_f}{r}$$

then:

$$2\frac{v_f^2}{r} - \frac{v_f^2}{\rho} = \frac{v_f^2}{r}(\sin\beta - \frac{\cos\beta}{\tan\epsilon});$$

$$\frac{1}{\rho} = \frac{2}{r} - \frac{\sin\beta - \frac{\cos\beta}{\tan\epsilon}}{r} ;$$

-continued $$\rho = \frac{r}{2 - \sin\beta + \frac{\cos\beta}{\tan\epsilon}} ;$$

Or, with tan $\epsilon > \mu$, then:

$$\rho > \frac{r}{2 - \sin\beta + \frac{\cos\beta}{\mu}} .$$

When this layout of the radius of curvature $\rho$ of the filament-guide passage 1, self-arrest of the filaments and clogging of the passage (tube) are avoided.

For the determination of $\rho$ there holds, therefore, the condition $$\frac{r}{2 - \sin\beta} > \rho > \frac{r}{2 - \sin\beta + \frac{\cos\beta}{\mu}} ,$$

in which the right half of this mathematical relation absolutely must be fulfilled and presents a critical limit.

In actual practice $\rho$ amounts to 50–90% of r. The greater values of $\rho$ come into consideration in the depositing of the more moist filament(s) and hold for large exit angles $\beta$.

With these considerations, it is possible to impart to the filament(s) after it/they leave the outlet opening 10 a downward continuing helical or spiral configuration 4. In order to impart to this helical or spiral configuration a pitch height (h) such that the individual helices do not touch each other and do not impede each other even with small, unavoidable air movements, a minimum pitch height is established which is governed according to the operating conditions, and depending on denier and multifilament number, should not lie below 10 to 20 mm. The angle $\alpha$ at which the outlet opening 10—as is to be seen from FIG. 2—is inclined downwardly relative to the plane of rotation of the outlet opening downward, is determined from the mathematical relation:

$$\tan\alpha = \frac{h}{2\pi R} .$$

The angle $\alpha$ lies, according to this invention, between 5° and 30°, and preferably is less than 15°. The pitch height (h) should, therefore, not be too small, so that the individual helices which form beneath the guide tube cannot have too small a translatory (vertical) velocity component in the direction of the collector or canister. If (h) were too small, it would make the overall configuration of the helical filament pattern subject to undesirable, but unavoidable air flows.

The radius (R) of the spirals or helices which the filament(s) form on emergence from the guide passage is dependent on the angles ($\alpha$) and ($\beta$) as well as on the radius (r) of the circle of rotation 17 of the outlet opening 10 of the guide tube 1. There also enter, however, as operating parameters, the filament velocity ($v_f$) and the rotation rate (n). In order to make superfluous an exact attuning of these operating parameters, the device—as described later in connection with FIG. 3—can be surrounded with a cage or shell—FIG. 9.

Further, it should be pointed out that, in operation, the rotation rate (n) of the thread guide tube 1 is preferably chosen in such a way that its circumferential velocity with respect to the diameter of the formed filament helices 4 is about 5 to 20% greater than the feed velocity of the filament(s) ($v_f$) upon their entry into the tube 1. This provides the advantage that adjustable centrifugal forces act on the filament(s) in the helices, which forces impact tension to the filament(s) and thereby a sufficient spatial stability to the helical pattern.

It may be mentioned, further, that ahead of the rotary guide tube, there can be an injector nozzle known per se, in order to make possible, in the starting of the device, feeding the filament(s) at a higher velocity $V_f$ to the guide tube 1. This injector can be used during the operation of the device, e.g., in the case of a high coefficient of friction $\mu$ being present. The latter is observed for example, with a pronouncedly moist filament(s) with a high finish content, for example 10%. The conveyance of the filament(s) 2 through the guide tube is promoted by the injected air flow.

It is obvious that, in still air, the helices 4 of the filament(s) are exposed to an air resistance. In order partially to compensate for this air resistance and to prevent a reduction of the pitch height h between the helices below an admissible value, an annular slot nozzle 5 is provided concentric to the rotation circle 17 of the emergence opening 10 and about at its height. Through this nozzle there is generated an annular curtain 11 of downward-directed air flow, in which curtain 11 the helices 4 of the filament(s) are situated and are conveyed downwardly. The annular slot nozzle 5 comprises a ring manifold **5*a* with a downwardly and radially inwardly directed, annular slot nozzle ring 5*b* forming a continuous, annular, air discharge slot 5*c***.

The embodiment of FIG. 3 likewise utilizes the principles of the device illustrated in FIG. 1 and FIG. 2. The filament guide passage **1*a* extends within the rotary body 18 (which may be solid or hollow) from its entrant end, which is substantially coaxial with the body's axis rotation 14, in downward and lateral composite curvature to its filament-emergence opening 10*a* in the surface of the body 18. The shaft of the rotary body 18 is journalled in ball bearings 8 and is driven in the direction of the arrow 16 by the drive belt 9*a*. The radius of the rotary body 18 first increases in the axial or downward direction and then decreases. In the embodiment illustrated, the rotary body consists of two coaxial, back-to-back truncated cones 18*a* and 18*b* having a common circular base or touching circular bases. The emergence opening 10*a* is located in the part 18*b* of the rotary body, the part with the downwardly diminishing transverse cross sections. The annular nozzle 5*b*' with its ring manifold 5*a*' lies about the upper part of the rotary body, so that the emerging air curtain 11*a* first has a widening radius and then, becomes constricted as the diameter of the rotary body decreases. The air curtain 11*a*, by the turning of the rotary body 18*a*, also has imparted thereto a component of movement in peripheral direction. The air curtain 11*a* imparts the desired downward conveyance effect, described in connection with FIG. 1 and FIG. 2 for the air curtain 11**, to the helical configuration of the filament(s).

By the construction of the rotor 18 with a coaxially tapered lower portion, formation of a "dead fluid zone" beneath the rotor is avoided. Further advantages of this form of the rotor **18*a* with its contained guide passage or tube 1*a*** lie in the improved aerodynamic properties of the device, in the increased rigidity of the device, in more readily and simpler weight balancing, and in its inherent better protection against accidents.

The embodiment of FIG. 3 has a cage 6. The cage 6 can be constructed as a shell tube. In the example illustrated, however, it consists of individual vertical, spaced, bars 15 about and substantially parallel to the axis of rotation 14. The upper ends of the bars 15 are mounted in a stationary ring 13. The radius of the circle on which these bars 15 lie concentrically about the rotary body 18 can be enlarged or diminished. Further, the bars can be inclined, so that the cage forms a downwardly flaring cage is truncated conical form. The cage begins about at the height of the rotation circle of the emergence opening **10*a* and can extend downwardly to the approximate upper edge of the collector or canister 7**.

The cage extends preferably a distance or about two to ten times the pitch height (h) of the helical configuration 4 of the filament(s) **2*a*** and serves the purpose of limiting the maximum radius (R) of this helical configuration.

The radially inward and outward adjustability of the bars 15, as well as their angular adjustability, can be achieved by many types of bar mounting structures. One suitable structure is illustrated in FIGS. 4 and 5, wherein a bar mounting ring 13 is positioned concentrically about the rotary body 18 at the desired height. Its underside has a plurality of circumferentially spaced, radial slots 32, one for each bar 15. The side walls of each slot have a longitudinal groove 33, 34, in which are slidably and rotatably mounted pins 35, 36 projecting from opposite sides of the upper part of bar 15. This mounting allows the bar 15 to be moved laterally in the radial slots 32 and/or pivoted about the axis of pins 35, 36 as indicated by the double headed arrows on FIG. 5. The bar is held frictionally in its adjusted position by tight, but sliding contact between the curved head portion 37 of bar 15 and the wall 38 of slot 32.

If the cage 6, which essentially serves the purpose during the start-up of the device of limiting the diameter of the filament helices is made as a hollow cylinder or a truncated, downwardly flaring hollow cone, each encasing and directing the downwardly directed air curtain, it is very advantageous to make them double-walled and to place sound-damping materials between the walls. The inner wall of the hollow body is finely perforated. Such are illustrated in FIG. 9.

The collector or canister 7, in turn the turns of filaments are deposited, preferably is moved reciprocally (arrows A) and/or rotatorily. This assures that the filament(s) is/are deposited uniformly over the horizontal cross section of the collector or canister and can be withdrawn therefrom later without difficulties. The body of collected filament(s) deposited in the collector or canister are superposed, overlying, spiral windings.

In FIGS. 6 and 7 a similar rotary body **18*a* has a self-contained or embedded filament guide channel or tube like that in FIG. 3. The rotary body 18*a* comprises two parts, the filament feed section 19 and the air expeller body 20 therebelow. The section 19 has a cylindrical head 19*a* from which flares the coaxial, frusto-conical, intermediate part 19*b*. The lower, coaxial frusto-conical part 19*c* has its circular base integral with the circular base of part 19*b*. The filament passage 1*b* is compositely curved like the passage 1*a* of FIG. 3, and its emergence opening 10*b* lies in the downwardly tapering surface 30 of the lower part 19*c*. The shown downward taper of frusto-conical surface 30 continues transitionally in the form of the tapered, frusto-conical surface 31 of the expeller body 20**.

In order to counteract the normally-occurring subpressure zone underneath the rotor, the part 19b has three, radially-inwardly and downwardly directed passages 21, 22, 23, which issue into a downwardly flaring, frusto-conical, concentric passage 24. Air blown through these passages through the rotor by a blower (not illustrated) connected to duct 25 exits at the lower end of the rotor 18a to counteract the normally-occurring subpressure zone. The arrows in FIG. 6 indicate the direction of the downward air flow, part of which flows through the annular spaces 28, 29 between the rotary body 18a and the flared ring 26 and the ring flange 27 formed on the lower end of the duct 25. The air curtain flowing through the annular space 28, 29 takes the form of a downwardly and radially inwardly flowing, annular stream of air about the tapered surfaces 30, 31 of the rotary body.

FIG. 9 shows the filament feeding device of FIGS. 1 and 2 within a hollow pot, casing or shell 40, open at the bottom, and optionally entirely open at the top. The pot, casing or shell 40 preferably is a double-wall, cylindrical (or downwardly flaring), stationary body positioned about and coaxial with the rotatable guide tube 1 and its issuing filament helices 4. Its radially spaced, cylindrical, inner wall 41 and outer wall 42 form an annular, cylindrical space 43 which is filled with sound-absorbing material 44, thus forming an annular, noise dampening liner. The inner wall 41 has many small perforations 45 (shown only in part) which allow passage of noise vibrations into the noise dampening liner where they are absorbed.

The upper side of the pot, casing or shell may be entirely open or, more preferably, is substantially closed off by a noise reflecting, top, ring wall 46 having a small, circular, coaxially central opening 47 to accommodate the guide tube 1. The hollow body 40 functions similarly to the cage 6 in terms of the effect on the air curtain 11 issuing from the annular slot nozzle 5 and on the filament helices 4 during start up and normal operation of the device. It extends downwardly below the emergence opening 10 for at least about two helices 4 (as formed in the normal operation), i.e., about 2 h, up to about 10 helices, i.e., about 10 h.

With the longer hollow bodies 40, i.e., those depending downwardly at about 3–10 h, they may be provided with one or more additional annular slot nozzles 48 having their respective annular nozzle slots 49 pitched downwardly and radially inwardly—thereby providing secondary, downwardly flow air curtains which supplement or modify the direction and/or velocity of the primary air curtain 11. In the illustrated embodiment, the nozzle slots 49 extend diagonally through the double walls 41, 42 and the liner 44 to provide a substantially uncluttered and continues cylindrical surface for the inner wall 41—the annular slot(s) 48 being flush with the inner wall. Here, an air-supply, manifold ring 50 is mounted about the outer wall and opposite the slot 49 in air tight relationship with the outer wall 41.

The embodiment of FIG. 10 comprises the rotor and duct as described and illustrated with reference to FIGS. 6 and 7. Like numerals designate like parts. This rotor is used in combination with a spaced bar cage 6 of the type described and illustrated with reference to FIGS. 3–5 and consists of vertical, spaced bars 15 about and substantially parallel to the axis of rotation of the rotary body 18a. The upper ends of the bars 15 are mounted in the stationary ring 13 which is adjacent and concentric with the lower end of the duct 25. Other details of the construction of the cage 6 have been described above with reference to FIGS. 3–5.

The injector nozzle 51 is of a type known per se, i.e., as described in U.S. Pat. No. 2,971,683, issued Feb. 14, 1961. The injector nozzle is positioned in the filament feed ahead of the rotary body 18a and makes possible, in the starting of the device, feeding the filaments at a higher velocity $V_F$ to the filament guide passage lb in the rotary body 18a.

The injector nozzle 51 is mounted on a fixed support 52, which has a central aperture 53 coaxial with the rotary body 18a. A connecting tube 54 with lower flange 55 is mounted on the support 52. A cover or cap 56 made of nylon or other abrasion-resistant material has an aperture 57 which is coaxial with the passage of the venturi tube 54 and the passage 1b of the rotary body and is seated between the flange 55 and the support 52.

Bearings and the rotary drive for the rotary body 18a are provided about the head 19a, for example, in the manner shown for bearings 8 and belt drive 9a in FIG. 3. These are omitted in FIGS. 6, 7 and 10 to facilitate illustration. The upper end of the head 19a is seated in and rotates in contact with the cover or cap 56.

A housing 58 providing a fluid chamber or manifold is mounted on the upper end of the tube 54 with the upper end of the tube projecting into the bottom of the housing 58 and injector fluid, e.g., air, is supplied through tube 59. The injector fluid exits into the venturi tube 54 through the annular space between the upper end of the tube 54 and the lower end of a co-axial filament feed tube 60 mounted in the upper wall of the housing 58 and extending vertically therethrough. Flow of the injector fluid from the housing 58 into the venturi tube 54 is designated in FIG. 10 by the arrows 61.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

We claim:

1. Apparatus for feeding filaments of synthetic, thermoplastic polymers in the form of helices to a collector, comprising a symmetrical rotary body rotatable about a vertical axis of rotation and having an upper section and a lower section, said lower section being a downwardly tapering, frusto-conical section coaxial with said vertical axis of rotation and tapering inwardly towards said vertical axis of rotation, said body having a filament passage of small diameter contained within said body, the upper, filament inlet portion of said passage being substantially coaxial with said vertical axis of rotation, said passage having an intermediate portion which extends in downward and lateral composite curvature from said inlet portion to a filament-emergence opening in the surface of said downwardly tapering, frusto-conical, lower section of said body in the upper portion of said lower section adjacent the upper end thereof, the tangent of the part of said passage adjacent said emergence opening being at an acute angle in the range of 30° to 80° relative to the radius of the circle of rotation of said emergency opening, said emergence opening being radially outwardly and axially downwardly spaced from said inlet portion of said passage whereby said opening orbits about said vertical axis of rotation in a circle of rotation, and an annular slot nozzle with an annular slot opening which is directed substantially downwardly and is positioned in proximity to said emergency opening and above and concentric with said circle of rotation and which is adapted to discharge a downwardly flowing, annular curtain of air which flows downwardly and radially inwardly about the tapered surface of said lower section and in which annular curtain of air the descending helices of the filaments are conveyed from said orbiting emergence opening and are laid as spiral windings in said collector.

2. Apparatus as claimed in claim 1 wherein said rotary body is a solid body, said upper section is a downwardly flaring, frusto-conical section in back-to-back relationship with said frusto-conical lower section, said solid body having air passages extending diagonally downwardly from its upper frusto-conical surface into the interior of said solid rotary body and intercepting an axial passage in said solid body running coaxially with said vertical axis of rotation through said lower section to its lower end, whereby air blown through said passages and exiting from said lower end prevent formation of a subpressure zone beneath said rotary body as it rotates.

3. Apparatus as claimed in claim 2 wherein said axial passage is a downwardly flaring, frusto-conical passage.

4. Apparatus as claimed in claim 1, and injector nozzle means above said rotary body for feeding said filaments at high velocity to said inlet portion of said passage in said rotary body, said nozzle having an axial filament passage aligned with said inlet portion, and means for injecting a stream of fluid into said axial filament passage to convey said filaments therethrough.

5. Apparatus as claimed in claim 1, a cage composed of a ring of circumferentially spaced, substantially vertical bars positioned concentrically about said rotary body and extending below said circle of rotation.

6. Apparatus as claimed in claim 5, and means pivotally mounting the upper ends of said bars for pivotal movement toward and away from the vertical axis of rotation of said rotary body and between a substantially cylindrical shape of said cage and a frusto-conical shape thereof.

7. Apparatus as claimed in claim 5, and means mounting the upper ends of said bars for sliding movement of each bar toward and away from the vertical axis of said rotary body.

8. Apparatus as claimed in claim 5, and a hollow cylinder, open at the bottom, positioned concentrically about said rotary body, and a noise-dampening liner on the cylindrical wall thereof.

9. In a process for laying filamentary helices in a collector container which includes the steps of feeding a strand of synthetic polymer multifilaments downwardly at a linear velocity of more than 1000 meters per minute, deflecting the downwardly fed multifilaments laterally from the vertical feed direction while superimposing a rotary, orbital movement to the laterally deflected multifilaments in a downwardly and horizontally, compositely curved filament passage orbiting about a vertical axis, and discharging the multifilaments running through said orbiting passage from a filament-emergence opening into the air in the form of downwardly falling, filamentary helices, the improvement comprising:

guiding said strand of multifilaments through said orbiting passage at filament curvatures within and corresponding to said passage wherein, throughout the entire three-dimensional curvature of said passage, the force of inertia of every portion of the correspondingly curved strand of multifilaments in the direction of the corresponding parts of the passage exceeds the frictional drag between the longitudinally moving multifilaments and wall of the passage, the tangent of the part of said passage adjacent said emergence opening being inclined at an acute angle in the range of 30° to 80° relative to the radius of the circle of rotation of said emergence opening;

driving said orbiting guide passage with such a rate of revolutions (n) that its circumferential velocity at the emergence opening with respect to the diameter (2R) of the generated filamentary helices is greater than the delivery velocity ($v_f$) of the strand of multifilaments just preceding their entrance into the guide passage, thereby providing adjustable centrifugal and tensional forces to act upon the strand of multifilaments in the helices and to impart sufficient spatial stability to the helical pattern; and discharging from a position above and concentric with said circle of rotation a downwardly flowing, annular curtain of air in which the descending helices of the filaments are conveyed from said orbiting emergence opening and are laid as spiral windings.

10. A process as claimed in claim 9 wherein the circumferential velocity at the filament-emergence opening of said orbiting guide passages exceeds the delivery velocity of the strand of multifilaments by an amount of about 5% up to a maximum of about 20%.

11. A process as claimed in claim 9 wherein the moisture content of said strand of multifilaments is less than 12% by weight.

12. A process as claimed in claim 9 wherein the moisture content of said strand of multifilaments is less than 5% by weight.

13. A process as claimed in claim 9 wherein said filament passage is in a rotary body rotating about a vertical axis of rotation, said rotary body having a downwardly tapering, frusto-conical, lower section coaxial with said vertical axis of rotation and tapering inwardly towards said vertical axis of rotation, the upper, filament inlet portion of said passage being substantially coaxial with said vertical axis of rotation, said passage having an intermediate portion which extends in downward and lateral composite curvature from said inlet portion to a filament-emergence opening in the surface of said downwardly tapering, frusto-conical, lower section of said body in the upper portion of said lower section adjacent the upper end thereof, the tangent of the part of said passage adjacent said emergence opening being at an acute angle in the range of 30° to 80° relative to the radius of the circle of rotation of said emergence opening, said emergence opening being radially outwardly and axially downwardly spaced from said inlet portion of said passage whereby said opening orbits about said vertical axis of rotation in a circle of rotation, and said annular curtain of air flowing downwardly and inwardly about the tapered surface of said lower section.

14. A process as claimed in claim 20, wherein the moisture content of said filaments is less than 5% by weight.

* * * * *

UNITED STATES PATENT AND TRADEMARK OFFICE

CERTIFICATE OF CORRECTION

PATENT NO. : 4,221,345

DATED : September 9, 1980

INVENTOR(S) : Schippers et al

It is certified that error appears in the above-identified patent and that said Letters Patent are hereby corrected as shown below:

In column 14, line 65, change "Claim 20" to read --Claim 13--.

Signed and Sealed this

*Twenty-fifth* Day of *November 1980*

[SEAL]

*Attest:*

SIDNEY A. DIAMOND

*Attesting Officer*

*Commissioner of Patents and Trademarks*